US009572432B2

(12) United States Patent
Deisig et al.

(10) Patent No.: US 9,572,432 B2
(45) **Date of Patent: *Feb. 21, 2017**

(54) FLEXIBLE BACK SUPPORT MEMBER WITH INTEGRATED RECLINE STOP NOTCHES

(71) Applicant: HNI CORPORATION, Muscatine, IA (US)

(72) Inventors: Wolfgang Deisig, Berlin (DE); Nils Koehn, Berlin (DE); Corey J. Susie, West Des Moines, IA (US); John R. Koch, Moline, IL (US); Phillip D. Minino, Muscatine, IA (US)

(73) Assignee: HNI Corporation, Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/065,236

(22) Filed: Oct. 28, 2013

(65) Prior Publication Data

US 2014/0183915 A1 Jul. 3, 2014

Related U.S. Application Data

(63) Continuation of application No. 13/209,257, filed on Aug. 12, 2011, now Pat. No. 8,567,864.

(51) Int. Cl.
*A47C 3/04* (2006.01)
*A47C 7/44* (2006.01)

(52) U.S. Cl.
CPC ..... *A47C 7/44* (2013.01); *A47C 3/045* (2013.01); *A47C 7/445* (2013.01); *A47C 7/448* (2013.01)

(58) Field of Classification Search
CPC ..... A47C 7/44; A47C 7/448
USPC ..... 297/296, 297, 285, 298, 299
See application file for complete search history.

(56) References Cited

U.S. PATENT DOCUMENTS

| | | | | |
|---|---|---|---|---|
| 809,944 | A | 1/1906 | Hanger | |
| 2,587,822 | A * | 3/1952 | Corning | 403/220 |
| 2,807,310 | A | 9/1957 | Sellner | |
| 2,921,622 | A | 1/1960 | Henrickson et al. | |
| 3,393,941 | A | 7/1968 | Grossfillex | |
| 3,934,932 | A | 1/1976 | Ekornes | |

(Continued)

FOREIGN PATENT DOCUMENTS

| | | |
|---|---|---|
| EP | 0196819 A2 | 10/1986 |
| EP | 2110051 A1 | 10/2009 |

(Continued)

OTHER PUBLICATIONS

International Search Report and Written Opinion issued in PCT/US2012/050393, mailed Aug. 21, 2013, 16 pages.

*Primary Examiner* — Timothy J Brindley
(74) *Attorney, Agent, or Firm* — Faegre Baker Daniels LLP

(57) ABSTRACT

A chair system according to embodiments of the present invention includes a base comprising a seat for a user and one or more support legs, a back, and a flexible back support element rigidly coupled to the back and to the base, the flexible back support element comprising a flex zone, the flex zone comprising one or more notches, wherein the back is reclinable from an upright position to a reclined position, wherein the one or more notches are configured to narrow as the back reclines from the upright position to the reclined position, and wherein the one or more notches are open in the upright position and closed in the reclined position.

20 Claims, 18 Drawing Sheets

(56) References Cited

U.S. PATENT DOCUMENTS

| | | | | | |
|---|---|---|---|---|---|
| 4,046,422 | A | | 9/1977 | Ambasz | |
| 4,084,850 | A | | 4/1978 | Ambasz | |
| 4,157,203 | A | | 6/1979 | Ambasz | |
| 4,379,589 | A | | 4/1983 | Marino | |
| 4,549,764 | A | * | 10/1985 | Haedo | 297/296 |
| 4,585,272 | A | | 4/1986 | Ballarini | |
| 4,709,962 | A | | 12/1987 | Steinmann | |
| 4,733,910 | A | | 3/1988 | Brennan | |
| 4,856,846 | A | | 8/1989 | Lohmeyer | |
| 4,869,552 | A | * | 9/1989 | Tolleson et al. | 297/296 |
| 4,880,273 | A | | 11/1989 | Markus | |
| 4,913,493 | A | | 4/1990 | Heidmann | |
| 4,979,778 | A | | 12/1990 | Shields | |
| 4,981,326 | A | | 1/1991 | Heidmann | |
| 4,984,846 | A | | 1/1991 | Ekornes | |
| 5,076,646 | A | | 12/1991 | Matte | |
| 5,102,196 | A | | 4/1992 | Kaneda et al. | |
| 5,244,252 | A | | 9/1993 | Serber | |
| 5,251,958 | A | | 10/1993 | Roericht et al. | |
| 5,303,978 | A | | 4/1994 | Murrey | |
| 5,314,237 | A | | 5/1994 | Koepke et al. | |
| 5,338,094 | A | | 8/1994 | Perry | |
| 5,340,197 | A | | 8/1994 | Vogtherr | |
| 5,383,712 | A | | 1/1995 | Perry | |
| 5,486,035 | A | | 1/1996 | Koepke et al. | |
| 5,522,182 | A | | 6/1996 | Rogers | |
| 5,558,399 | A | | 9/1996 | Serber | |
| 5,597,203 | A | | 1/1997 | Hubbard | |
| 5,599,069 | A | | 2/1997 | Lorbiecki | |
| 5,611,598 | A | | 3/1997 | Knoblock | |
| 5,660,439 | A | | 8/1997 | Unwalla | |
| 5,725,277 | A | | 3/1998 | Knoblock | |
| 5,735,574 | A | | 4/1998 | Serber | |
| 5,785,384 | A | | 7/1998 | Sagstuen | |
| 5,806,930 | A | | 9/1998 | Knoblock | |
| 5,810,438 | A | | 9/1998 | Newhouse | |
| 5,904,397 | A | * | 5/1999 | Fismen | 297/291 |
| 5,909,923 | A | | 6/1999 | DeKraker | |
| 5,957,534 | A | | 9/1999 | Wilkerson et al. | |
| 5,979,984 | A | | 11/1999 | DeKraker et al. | |
| 6,056,361 | A | | 5/2000 | Cvek | |
| 6,070,937 | A | | 6/2000 | Ginat | |
| 6,109,696 | A | | 8/2000 | Newhouse et al. | |
| 6,257,665 | B1 | | 7/2001 | Nagamitsu et al. | |
| 6,435,615 | B1 | | 8/2002 | Zapf | |
| 6,533,352 | B1 | | 3/2003 | Glass et al. | |
| 6,554,360 | B1 | | 4/2003 | Wilke et al. | |
| 6,641,214 | B2 | | 11/2003 | Veneruso | |
| 6,722,735 | B2 | | 4/2004 | Lucci et al. | |
| 6,739,663 | B2 | | 5/2004 | Gevaert | |
| 6,739,665 | B1 | | 5/2004 | Leib et al. | |
| 6,779,846 | B2 | | 8/2004 | Spendlove et al. | |
| 6,786,548 | B2 | | 9/2004 | Pearce et al. | |
| 6,896,327 | B1 | * | 5/2005 | Barile, Sr. | 297/297 |
| 6,923,503 | B2 | | 8/2005 | Sangiorgio | |
| 6,935,690 | B2 | | 8/2005 | Lucci et al. | |
| 6,986,549 | B2 | | 1/2006 | Kniese | |
| 7,004,543 | B2 | | 2/2006 | Caruso et al. | |
| 7,073,860 | B2 | | 7/2006 | Markus | |
| 7,073,864 | B2 | | 7/2006 | Olsen | |
| 7,114,777 | B2 | | 10/2006 | Knoblock et al. | |
| 7,114,782 | B2 | | 10/2006 | Ambasz | |
| 7,118,177 | B2 | | 10/2006 | Piretti | |
| 7,234,774 | B2 | | 6/2007 | Heidmann et al. | |
| 7,334,842 | B1 | | 2/2008 | Wu | |
| 7,360,835 | B2 | | 4/2008 | Tubergen et al. | |
| 7,472,962 | B2 | | 1/2009 | Caruso et al. | |
| 7,611,202 | B2 | | 11/2009 | Johnson et al. | |
| 7,621,600 | B2 | | 11/2009 | Buchbinder | |
| 7,686,395 | B2 | | 3/2010 | Piretti | |
| 7,695,067 | B2 | | 4/2010 | Goetz et al. | |
| 8,567,864 | B2 | | 10/2013 | Deisig et al. | |
| 2007/0063563 | A1 | | 3/2007 | Maze et al. | |
| 2008/0272636 | A1 | | 11/2008 | Machael et al. | |
| 2009/0102268 | A1 | | 4/2009 | Schmitz et al. | |
| 2009/0195040 | A1 | | 8/2009 | Birkbeck | |
| 2009/0261644 | A1 | | 10/2009 | Piretti | |
| 2013/0038110 | A1 | | 2/2013 | Deisig et al. | |

FOREIGN PATENT DOCUMENTS

| | | | |
|---|---|---|---|
| EP | 2272401 | A2 | 1/2011 |
| WO | WO2009039231 | A2 | 3/2009 |

* cited by examiner

SECTION A-A
NOTCHED SECTION
(FOR BENDING)

SECTION B-B
STOP SECTION
(RECLINE STOP)

SECTION C-C
ATTACHMENT SECTION

FLEXING PLASTIC STRUCTURE WITH FLAT-SPRING AND STOP AT THE END

FLEXING PLASTIC STRUCTURE WITH 2 PARALLEL WORKING FLAT-SPRINGS AND STOP

FLEXING PLASTIC STRUCTURE WITH STEEL OR CARBON-FIBER ROD

FLEXIBLE BACK SUPPORT MEMBER WITH INTEGRATED RECLINE STOP NOTCHES

CROSS-REFERENCE TO RELATED APPLICATION

This application is a continuation of U.S. patent application Ser. No. 13/209,257, entitled "FLEXIBLE BACK SUPPORT MEMBER WITH INTEGRATED RECLINE STOP NOTCHES," and having a filing date of Aug. 12, 2011, which is incorporated herein by reference in its entirety for all purposes.

TECHNICAL FIELD

Embodiments of the present invention relate generally to reclining chairs, and more specifically to reclining chairs having flexible back support members.

BACKGROUND

Existing chairs with reclining backs often employ complex mechanisms to accommodate reclining motion, and such complex mechanisms are often expensive to manufacture. Chairs with plastic or polymer reclining backs often wear out rapidly at the point of primary bending, are often too stiff or too flimsy throughout reclining, and often their reclining resistance typically does not vary throughout reclining.

SUMMARY

A chair system according to embodiments of the present invention includes a base including a seat for a user and one or more support legs, a back, and a flexible back support member rigidly coupled to the back and to the base, the flexible back support member comprising a flex zone, the flex zone comprising one or more notches, wherein the back is reclinable from an upright position to a reclined position, wherein the one or more notches are configured to narrow as the back reclines from the upright position to the reclined position, and wherein the one or more notches are open in the upright position and closed in the reclined position. The flex zone of such a chair system includes a beam section and an insert section, the beam section including a top beam section extending continuously along the flex zone and two or more bottom beam sections integrally formed with the top beam section, wherein the two or more bottom beam sections are separated from each other longitudinally by one or more gaps, and the insert section may be coupled, for example removably coupled, to the beam section and include one or more bottom inserts each positioned within one of the one or more gaps, wherein each of the one or more notches is formed between the one or more bottom inserts and a longitudinally adjacent bottom beam section of the two or more bottom beam sections.

A minimum area moment of inertia longitudinally along the flex zone in the upright position may be smaller than a minimum area moment of inertia longitudinally along the flex zone in the reclined position. Also, each of the one or more notches may have a substantially uniform width in the upright position.

A cross-sectional shape of each of the two or more bottom beam sections may be substantially similar to a cross-sectional shape of each of the one or more bottom inserts. The beam section may further include a metal wire extending at least partially along the flex zone, and the metal wire may be, for example, an insert molded steel spring wire. The insert section may further include a crosspiece coupled to the one or more bottom inserts, and the insert section may be removably coupled to the beam section via the crosspiece. The beam section may also further include a first lateral interlock element in a first gap of the one or more gaps, and the insert section may include a second lateral interlock element that interlocks with the first lateral interlock element when the insert section is removably coupled to the beam section.

According to some embodiments of the present invention, the two or more bottom beam sections is five bottom beam sections, the one or more gaps is four gaps, and the one or more bottom inserts is four bottom inserts. According to some embodiments of the present invention, the flexible back support member is a first flexible back support member, the flex zone is a first flex zone, and the one or more notches is a first set of one or more notches, and the chair system further includes a second flexible back support member rigidly coupled to the back and to the base, the second flexible back support member including a second flex zone, the second flex zone including a second set of one or more notches, wherein the second set of one or more notches are configured to narrow as the back reclines from the upright position to the reclined position, and wherein the second set of one or more notches are open in the upright position and closed in the reclined position.

According to some embodiments of the present invention, the beam section and the insert section are each molded as a single unit and are each molded of the same material. The flexible back support member may include a substantially homogeneous and isotropic modulus of elasticity. In some cases, the beam section and/or the insert section may be formed of a molded polymer. According to some embodiments, the insert section is a first insert section, the one or more bottom inserts is a first set of one or more bottom inserts, the one or more notches is a first set of one or more notches, and the chair system further includes a second insert section configured to be removably coupled to the beam section, the second insert section including a second set of one or more bottom inserts each configured to be positioned within one of the one or more gaps, wherein each of a second set of one or more notches is formed between the second set of one or more bottom inserts and a longitudinally adjacent bottom beam section of the two or more bottom beam sections, wherein each notch of the first set of one or more notches is narrower in the upright position than each notch of the second set of one or more notches in the upright position.

A chair system according to embodiments of the present invention includes a base with a seat for a user and one or more support legs, a back, and a flexible back support member rigidly coupled to the back and to the base, the flexible back support member including a flex zone which includes one or more notches, wherein the back is reclinable from an upright position to a reclined position, wherein the one or more notches are configured to narrow as the back reclines from the upright position to the reclined position, and wherein the one or more notches are open in the upright position and closed in the reclined position, wherein a cross-sectional shape of the flexible back support member between the one or more notches is substantially I-shaped, and wherein the cross-sectional shape at the one or more notches is substantially T-shaped.

According to such embodiments, a minimum area moment of inertia longitudinally along the flex zone in the upright position is smaller than a minimum area moment of inertia longitudinally along the flex zone in the reclined position. According to some embodiments of the present invention, the flex zone includes a beam section having a top beam section extending continuously along the flex zone and two or more bottom beam sections integrally formed with the top beam section, wherein the two or more bottom beam sections are separated from each other longitudinally by one or more gaps, and an insert section removably coupled to the beam section, the insert section including one or more bottom inserts each positioned within one of the one or more gaps, wherein each of the one or more notches is formed between the one or more bottom inserts and a longitudinally adjacent bottom beam section of the two or more bottom beam sections.

The beam section may further include a metal wire extending at least partially along the flex zone, for example an insert molded steel spring wire. The insert section may include a crosspiece coupled to the one or more bottom inserts, and the insert section may be removably coupled to the beam section via the crosspiece.

The beam section may also include a first lateral interlock element in a first gap of the one or more gaps, and the insert section may also include a second lateral interlock element that interlocks with the first lateral interlock element when the insert section is removably coupled to the beam section. In some cases, the two or more bottom beam sections is five bottom beam sections, and the one or more gaps is four gaps, and the one or more bottom inserts is four bottom inserts. The beam section and/or the insert section may be formed of a molded polymer.

A method for making a chair according to embodiments of the present invention includes forming a flexible back support member, the flexible back support member including a flex zone, the flex zone including a beam section, the beam section including a top beam section extending continuously along the flex zone and two or more bottom beam sections integrally formed with the top beam section, wherein the two or more bottom beam sections are separated from each other longitudinally by one or more gaps, rigidly coupling the flexible back support member with a base and a back, the base including a seat for a user and one or more support legs, positioning each of one or more bottom inserts of an insert section within one of the one or more gaps to form one or more notches between the one or more bottom inserts and a longitudinally adjacent bottom beam section of the two or more bottom beam sections, and coupling the insert section to the beam section.

According to some embodiments of the present invention, the back is reclinable from an upright position to a reclined position, and the one or more notches are open in the upright position and closed in the reclined position, the method further including reclining the back from the upright position to the reclined position to narrow the one or more notches. Reclining may further include reclining the back from the upright position to the reclined position to narrow the one or more notches until the one or more notches are closed. Such embodiments of methods may further include customizing a width of the one or more notches by selecting a width for the one or more gaps larger than a width of the one or more bottom inserts. A crosspiece may be formed to couple to the one or more bottom inserts, and coupling the insert section to the beam section may include coupling the crosspiece to the beam section.

According to some embodiments of such methods, a metal wire, for example a steel spring wire, may be insert molded at least partially along the flex zone. In some cases, the beam section further includes a first lateral interlock element in a first gap of the one or more gaps, and the insert section includes a second lateral interlock, and the method includes interfitting the first lateral interlock element with the second lateral interlock element when the insert section is coupled to the beam section. In some cases, coupling the insert section to the beam section includes removably coupling the insert section to the beam section. According to some embodiments of the present invention, forming the flexible back support member includes molding the flexible back support member with polymer as a single unitary piece.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
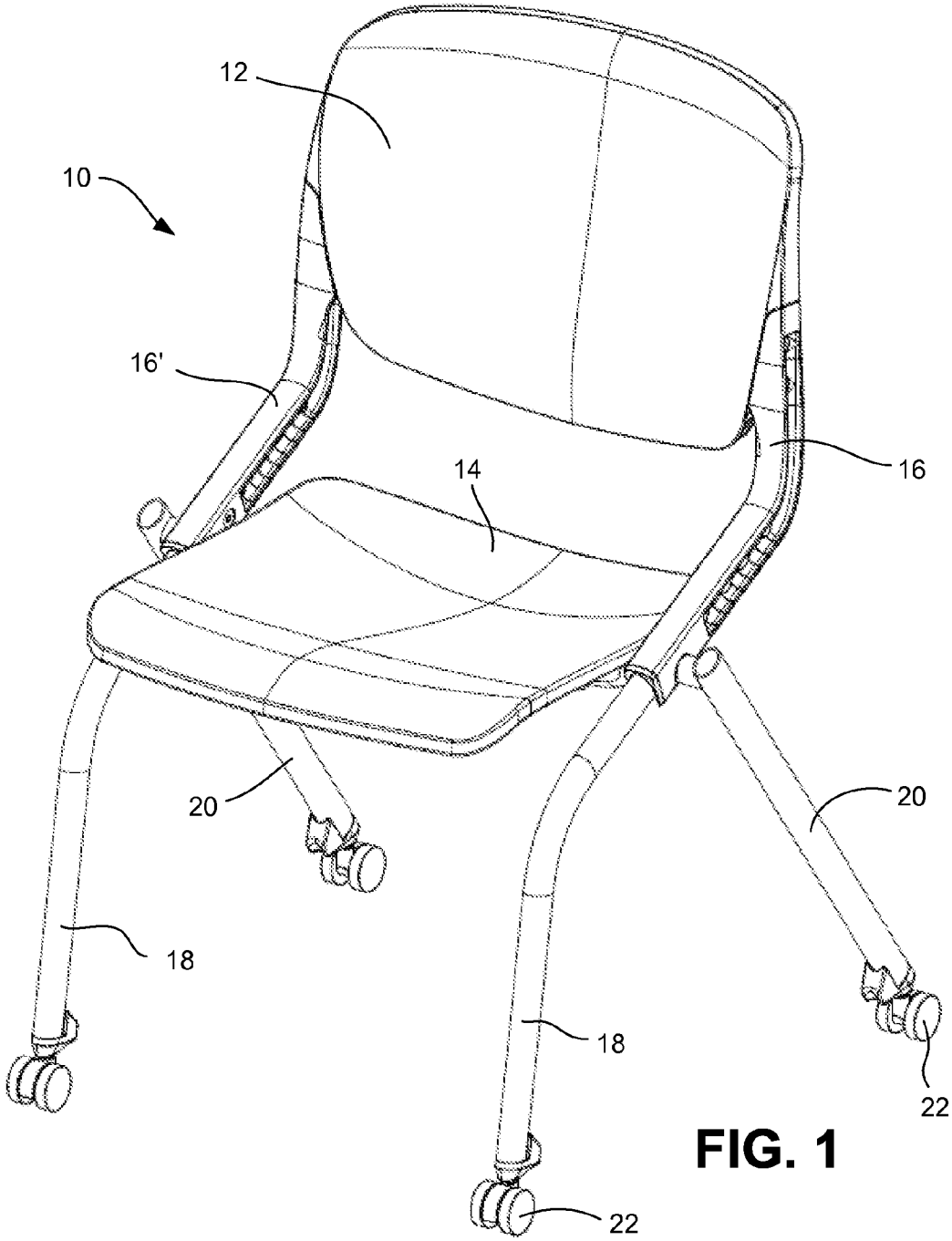
FIG. 1 illustrates a front perspective view of a chair system, according to embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 2:
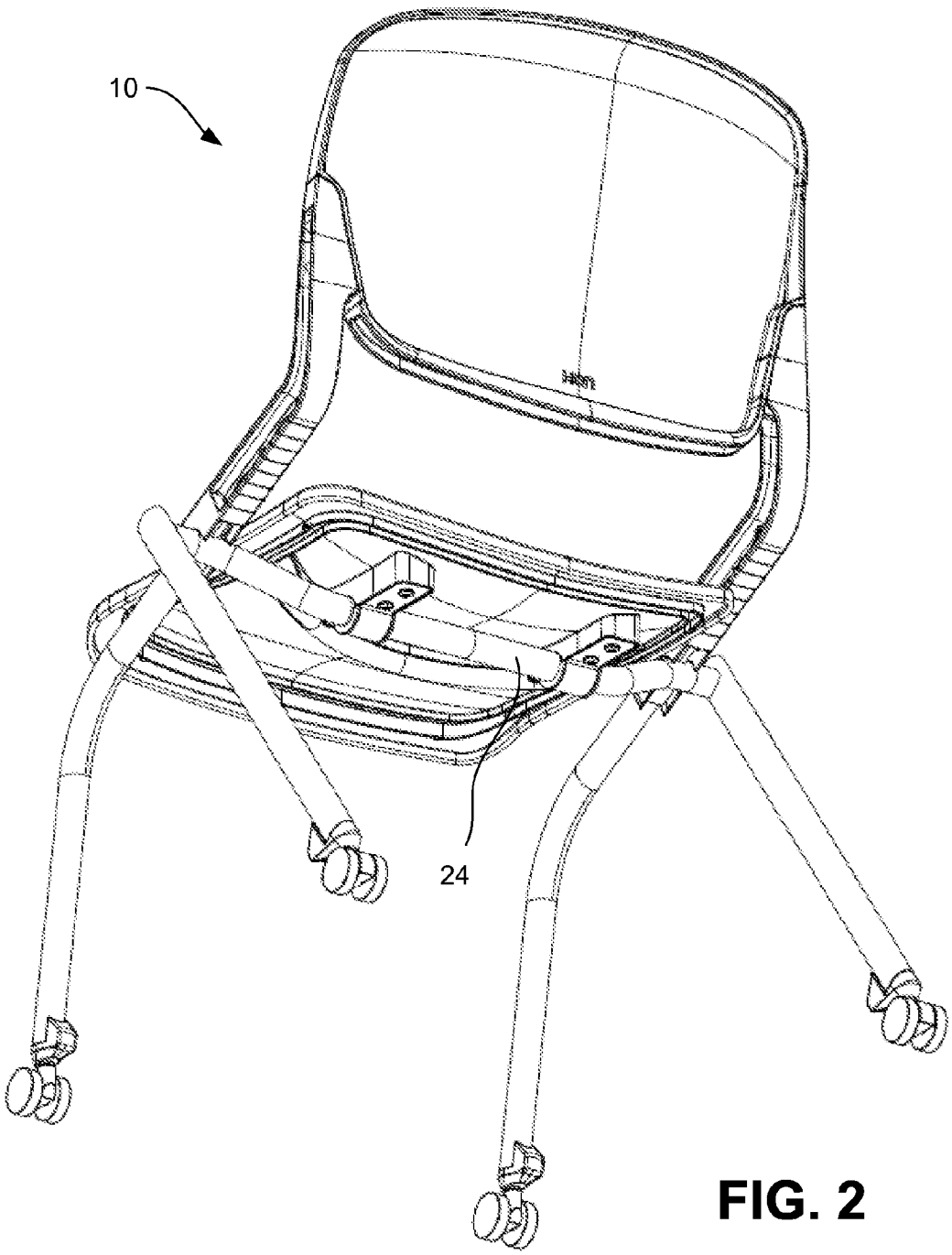
FIG. 2 illustrates a rear perspective view of the chair system of FIG. 1, according to embodiments of the present invention.
Figure 3:
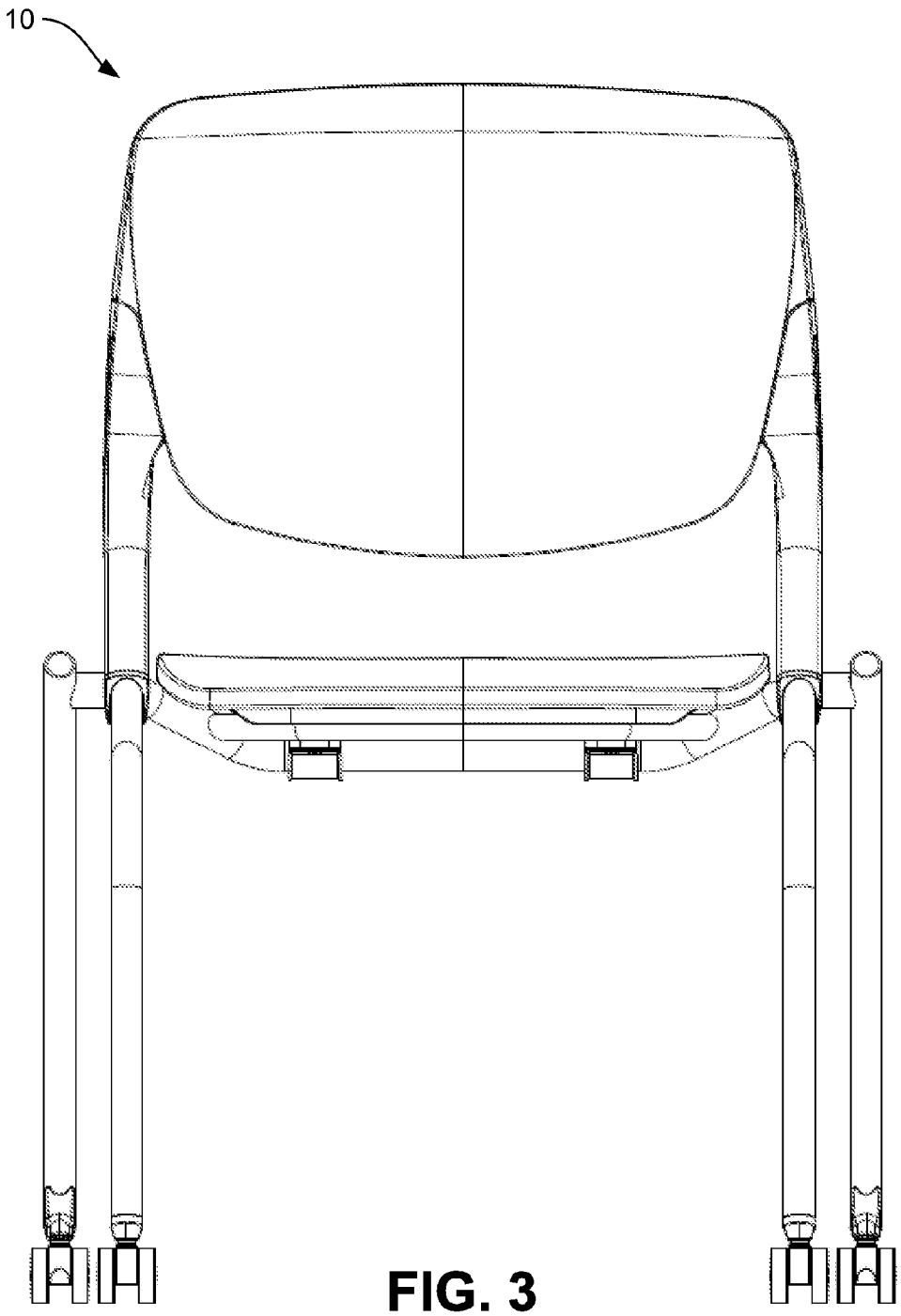
FIG. 3 illustrates a front view of the chair system of FIGS. 1 and 2, according to embodiments of the present invention.
Figure 4:
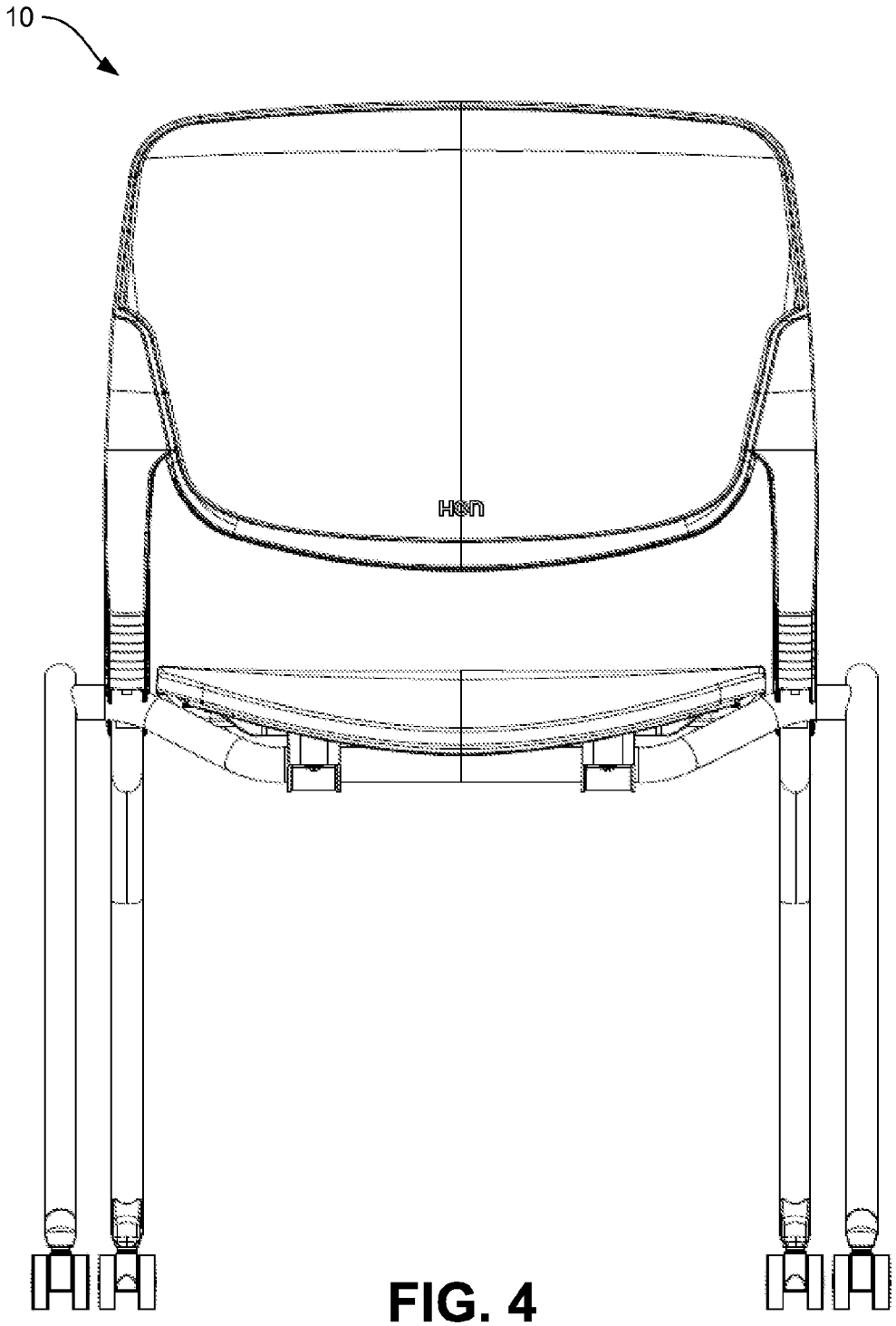
FIG. 4 illustrates a rear view of the chair system of FIGS. 1 to 3, according to embodiments of the present invention.
Figure 5:
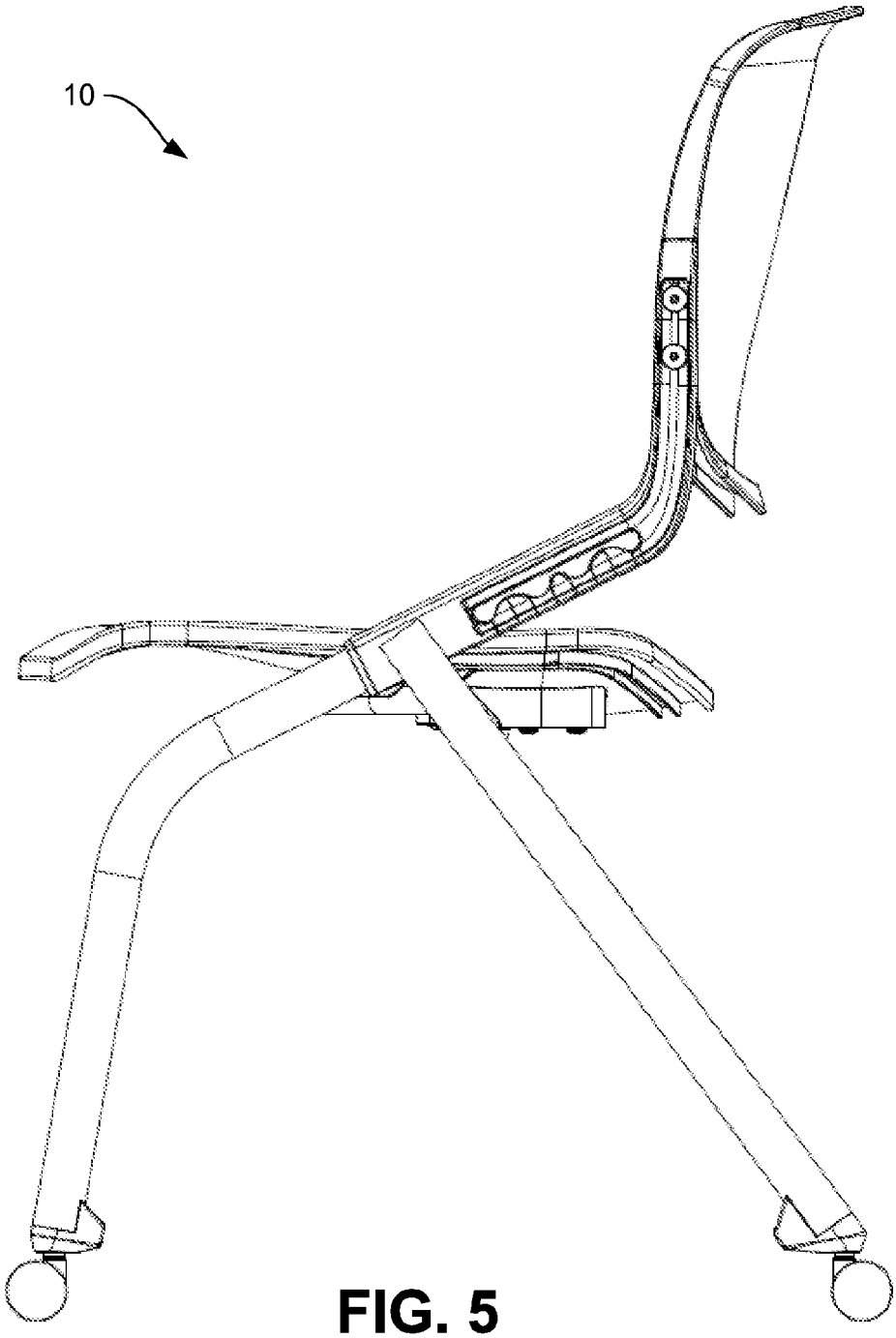
FIG. 5 illustrates a right side view of the chair system of FIGS. 1 to 4, according to embodiments of the present invention.
Figure 6:
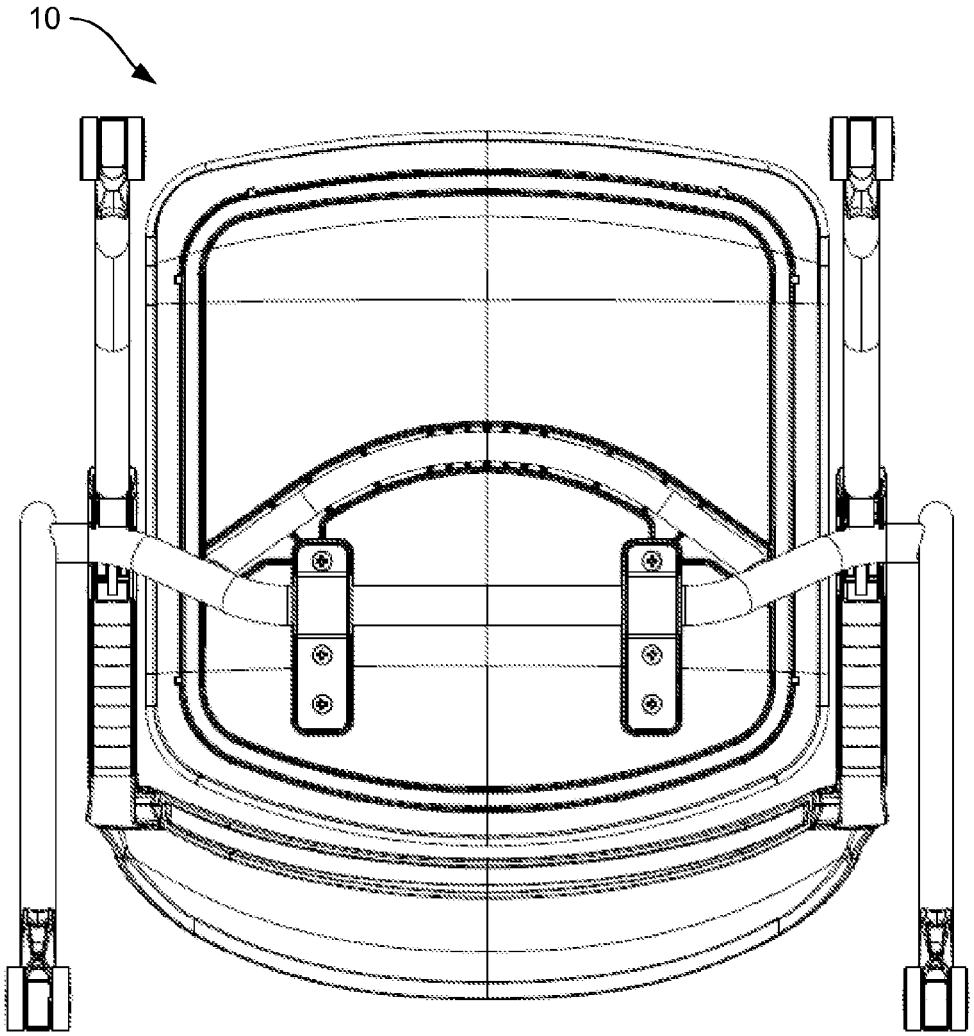
FIG. 6 illustrates a bottom view of the chair system of FIGS. 1 to 5, according to embodiments of the present invention.

FIG. 1 illustrates a front perspective view, FIG. 2 illustrates a rear perspective view, FIG. 3 illustrates a front view, FIG. 4 illustrates a rear view, FIG. 5 illustrates a right side view, and FIG. 6 illustrates a bottom view of a chair system 10, according to embodiments of the present invention. Chair system 10 includes a back 12 and a seat 14 for a user, and front support legs 18 and back support legs 20. the legs 18, 20 may each include a roller or caster 22, according to embodiments of the present invention. The legs 18, 20 may further be coupled to each other and to the seat 14 by a seat crossbar 24. The legs 18, 20 and/or crossbar 24 may collectively be referred to as the base of the chair. Although a chair base having four legs is shown, one of ordinary skill in the art will appreciate, based on the present disclosure that other bases may be used, for example a pedestal base with a central support and side legs, according to embodiments of the present invention.

A flexible back support member 16 is rigidly coupled to the back 12 and to the base (e.g. to the leg 18 which is rigidly coupled to leg 20, seat 14, and/or crossbar 24). Another back support member 16', which is a mirror of back support member 16, may be located on the other side of the chair, to couple the back 12 to the base, according to embodiments of the present invention. As used herein, the term "coupled" is used in its broadest sense to refer to elements which are connected, attached, and/or engaged, either directly or integrally or indirectly via other elements, and either permanently, temporarily, or removably.

Figure 7:
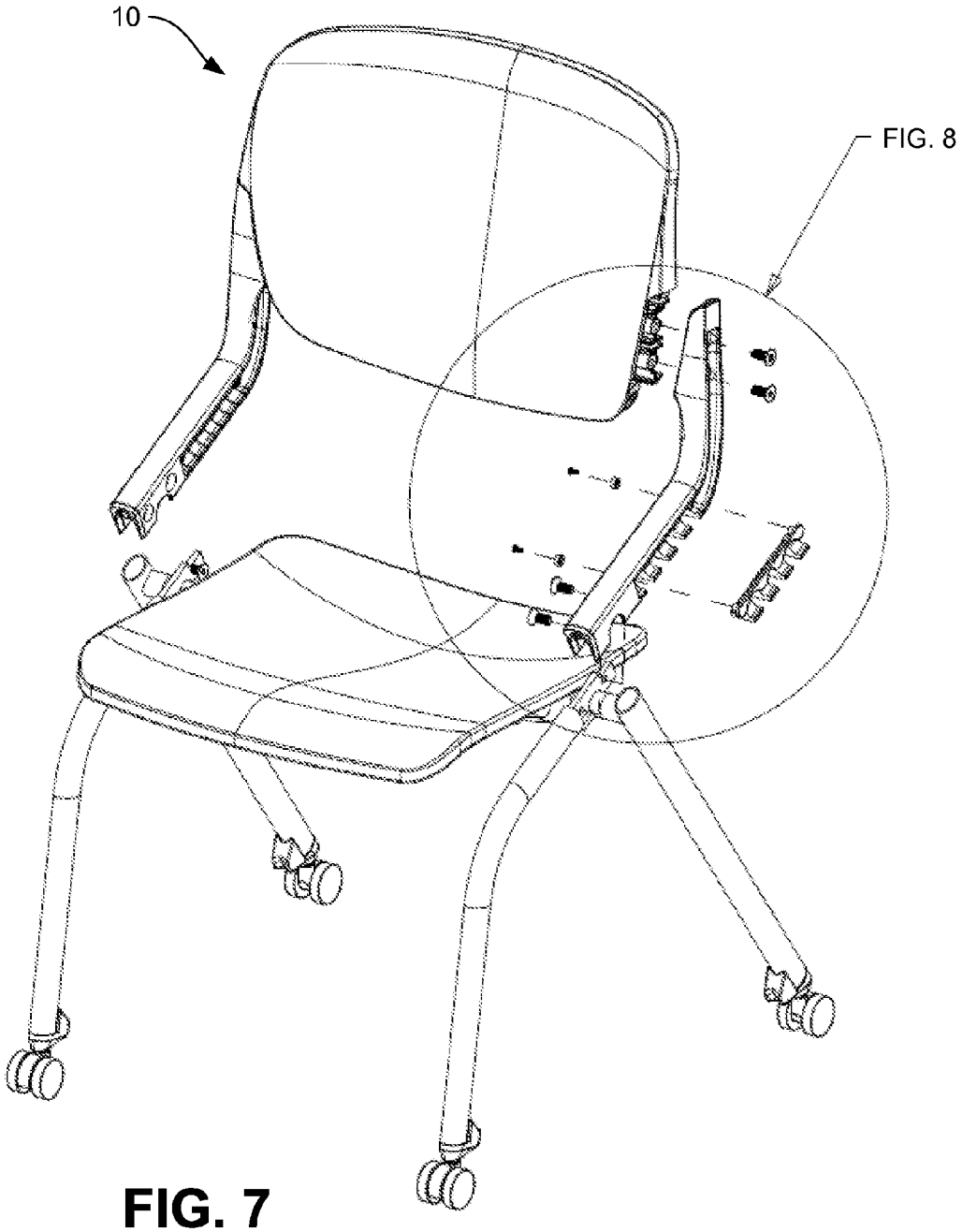
FIG. 7 illustrates a front perspective partial exploded view of the chair system of FIGS. 1 to 6, according to embodiments of the present invention.
Figure 8:
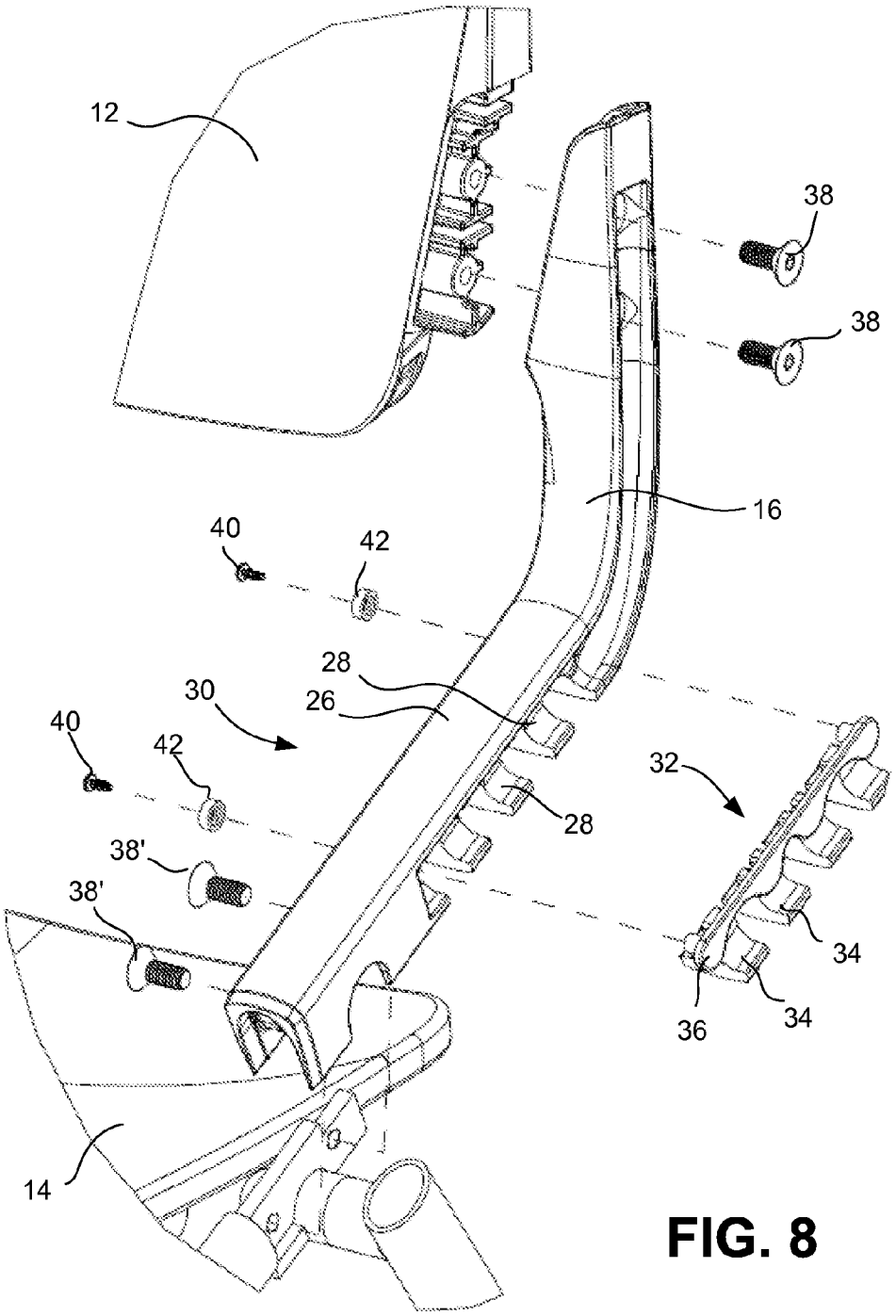
FIG. 8 illustrates an enlarged perspective view of the flexible back support member of FIG. 7, according to embodiments of the present invention.

FIG. 7 illustrates a front perspective partial exploded view of the chair system 10 of FIGS. 1 to 6, according to embodiments of the present invention. FIG. 8 illustrates an enlarged perspective view of the flexible back support member of FIG. 7, according to embodiments of the present invention. The flexible back support member 16 is rigidly coupled to the base with screws 38 as illustrated, and is rigidly coupled to the seat 12 with screws 38' as illustrated, although other attachment mechanisms may be used, according to embodiments of the present invention. Flexible back support member 16 includes a flex zone 48 (see FIG. 11), which in turn includes a beam section 30 and an insert section 32, according to embodiments of the present invention. Beam section 30 includes a top beam section 26 extending continuously along the flex zone 48, and bottom beam sections 28 which are integrally formed with the top beam section 26, and separated from one another longitudinally by gaps 44 (see FIG. 10), according to embodiments of the present invention. As used herein, the term "longitudinally" is used to refer to the direction indicated generally by arrow 60 of FIG. 13, and to a direction which travels along a longest dimension or length of an element, including curved elements.

The beam section 30 may be made of nylon, to give it a high flexibility, low modulus of elasticity, and high strength, according to embodiments of the present invention. The beam section 30 may be molded of PA6 nylon, for example.

The insert section 32, which may be removably coupled to the beam section 30, for example via screws 40 and washers 42 as illustrated, may include bottom inserts 34, according to embodiments of the present invention. Each of the bottom inserts 34 may be placed into one of the gaps 44, such that notches 50 (see FIG. 13) are formed between one side 54 of a bottom beam section 28 and the facing side 52 of an adjacent bottom insert 34 (see FIG. 12), according to embodiments of the present invention. The insert section 32 may also include a crosspiece 36 coupled to the bottom inserts 34, and the insert section 32 may be removably coupled to the beam section 30 via the crosspiece 36, as illustrated, according to embodiments of the present invention.

The insert section 32 may be formed of polypropylene, according to embodiments of the present invention. When the beam section 30 is nylon or similar material and the insert section 32 is polypropylene or similar material, the insert section 32 does not contribute as much to, or have stresses as high in bending as, the main beam section 30, according to embodiments of the present invention.

Figure 9:
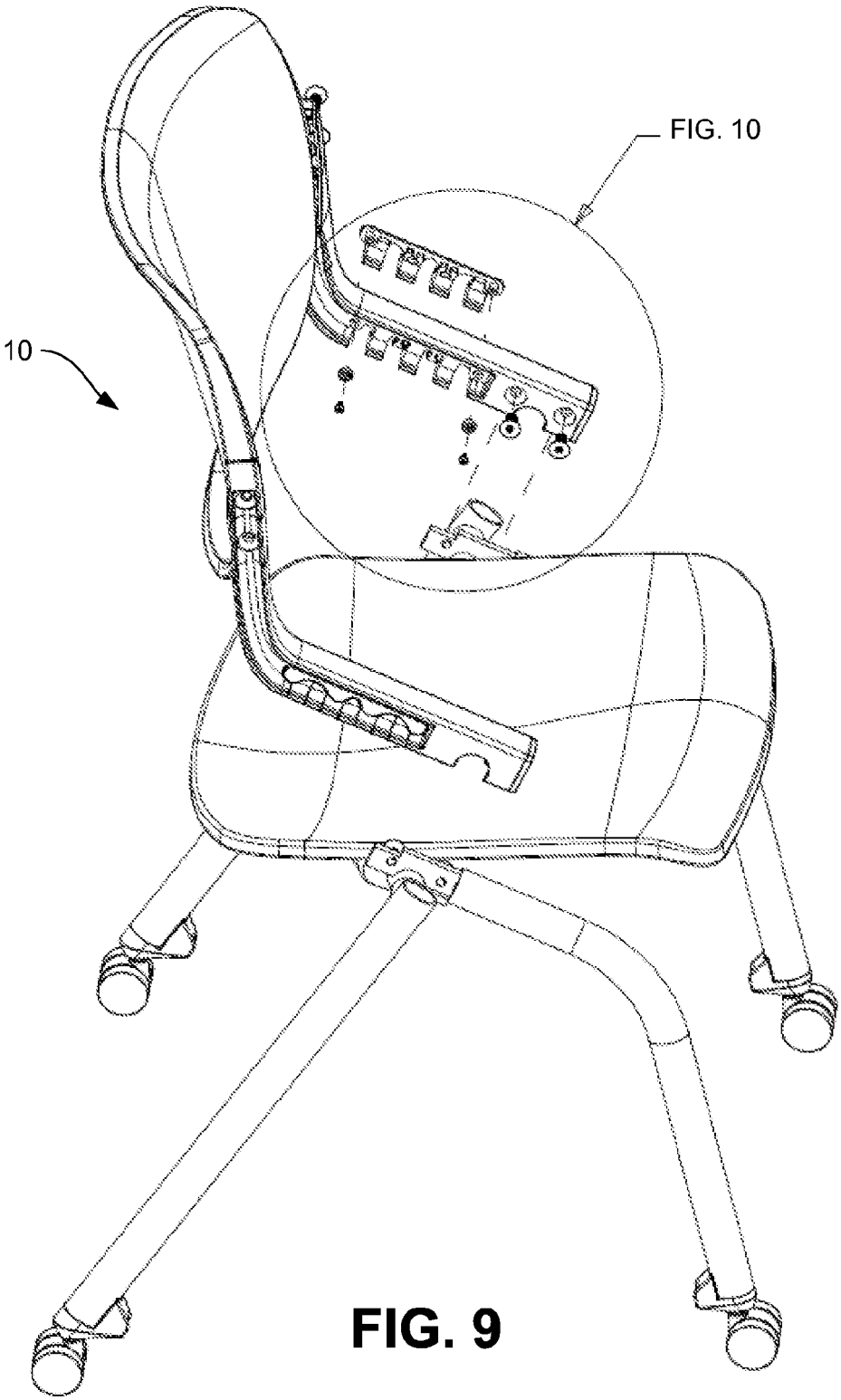
FIG. 9 illustrates another front perspective partial exploded view of the chair system of FIGS. 1 to 6, according to embodiments of the present invention.
Figure 10:
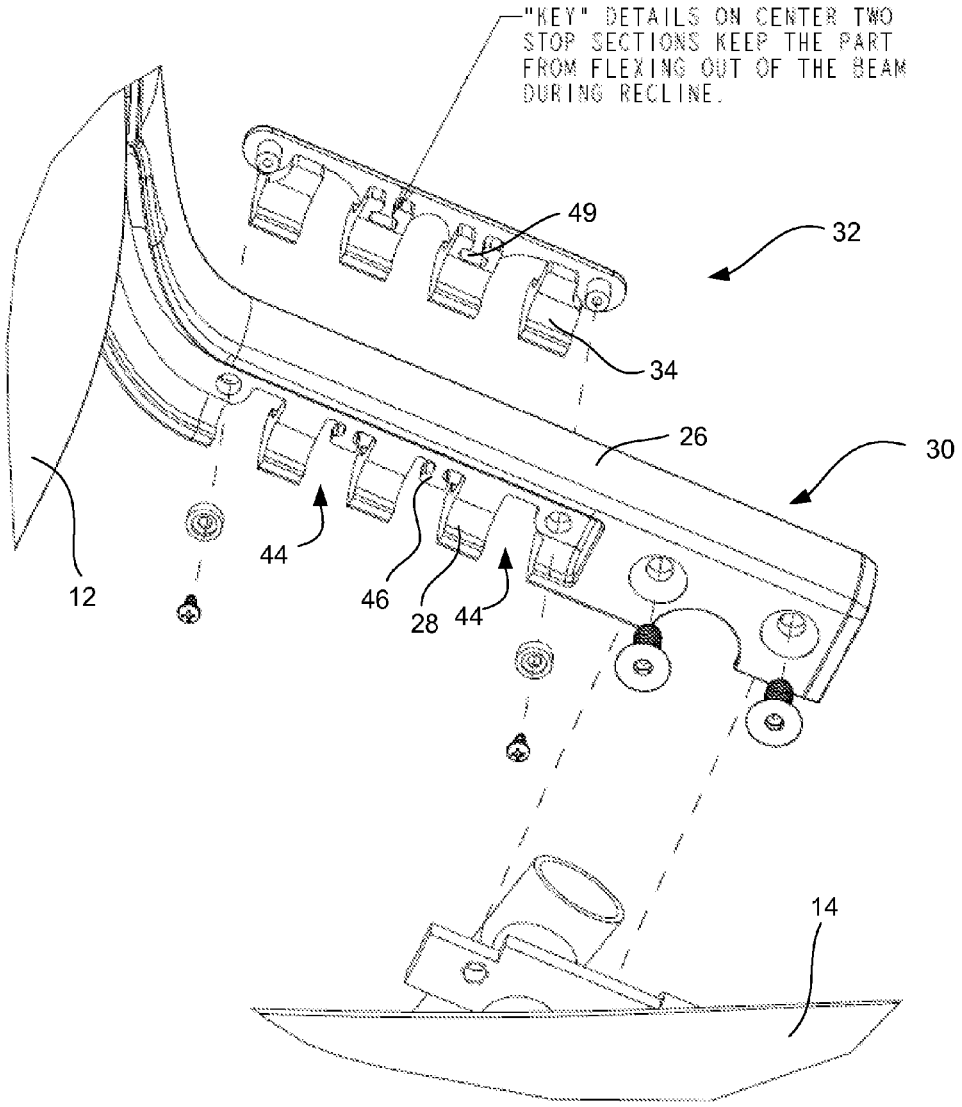
FIG. 10 illustrates another enlarged perspective view of the flexible back support member of FIG. 9, according to embodiments of the present invention.

FIG. 9 illustrates another front perspective partial exploded view of the chair system 10 of FIGS. 1 to 6, and FIG. 10 illustrates another enlarged perspective view of the flexible back support member 16 of FIG. 9, according to embodiments of the present invention. The beam section 30 may also include interlocking elements 46, which are shown in FIG. 10 as inverted T-shaped elements. The insert section 32 includes interlocking elements 49 which interlock with interlock elements 46. For example, the interlock elements 49 include a receptacle of a shape configured to interlock and/or mesh with the shape of the interlocking element 46 when the insert section 32 is removably coupled to the beam section 30. Based on the disclosure provided herein, one of ordinary skill in the art will recognize the various interlocking shape combinations, and placements, which may be used to form interlocking elements 46, 49.

Figure 11:
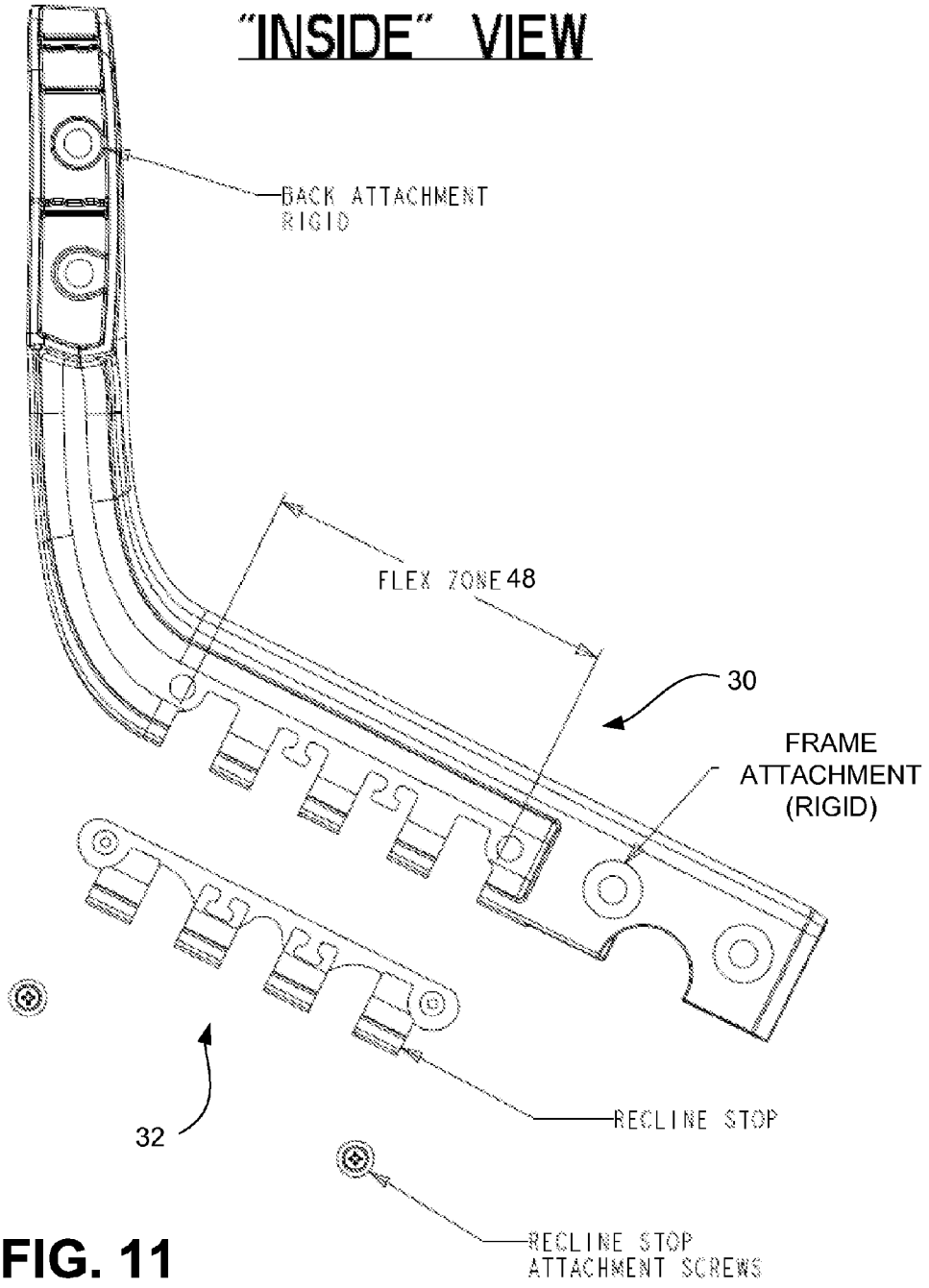
FIG. 11 illustrates an inside exploded view of a flexible back support member, according to embodiments of the present invention.
Figure 12:
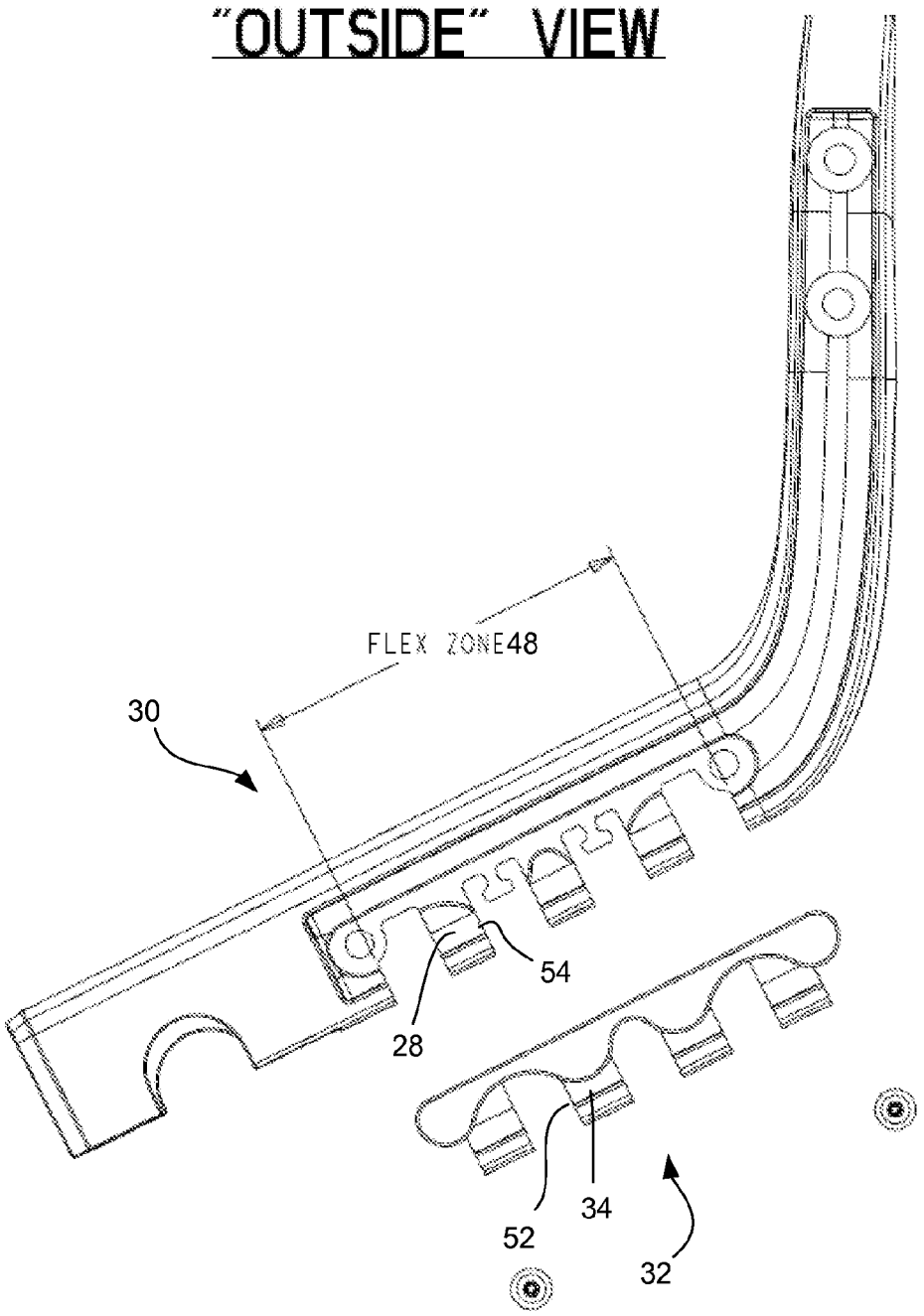
FIG. 12 illustrates an outside exploded view of a flexible back support member, according to embodiments of the present invention.
Figure 13:
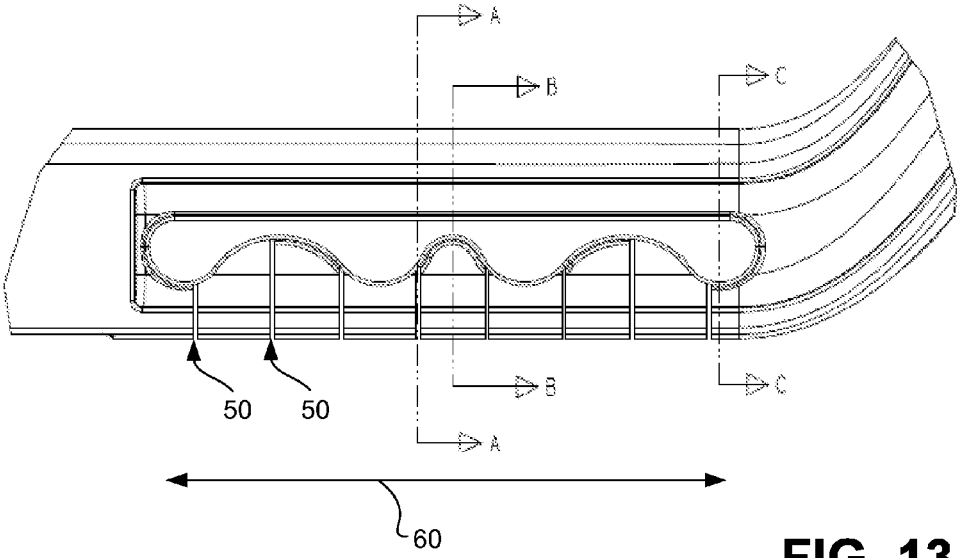
FIG. 13 illustrates a partial cut-away side view of a flexible back support member, according to embodiments of the present invention.
Figure 14:
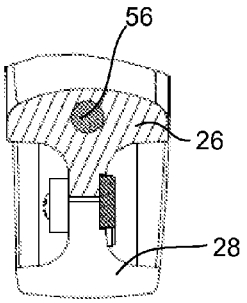
FIG. 14 illustrates a cross-sectional view of the flexible back support member of FIG. 13, taken along line A-A of FIG. 13, according to embodiments of the present invention.
Figure 15:
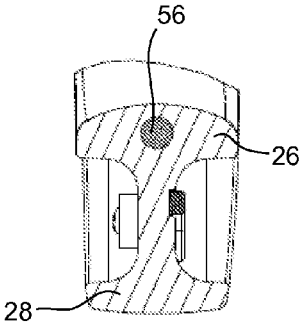
FIG. 15 illustrates a cross-sectional view of the flexible back support member of FIG. 13, taken along line B-B of FIG. 13, according to embodiments of the present invention.
Figure 16:
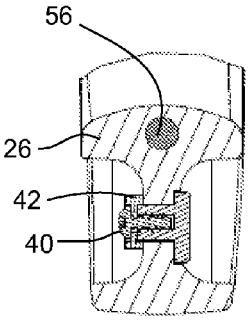
FIG. 16 illustrates a cross-sectional view of the flexible back support member of FIG. 13, taken along line C-C of FIG. 13, according to embodiments of the present invention.

FIG. 11 illustrates an inside exploded view of a flexible back support member 16, and FIG. 12 illustrates an outside exploded view of a flexible back support member 16, according to embodiments of the present invention. FIG. 13 illustrates a partial cut-away side view of a flexible back support member 16, according to embodiments of the present invention. FIG. 14 illustrates a cross-sectional view of the flexible back support member 16, taken along line A-A of FIG. 13, according to embodiments of the present invention. FIG. 15 illustrates a cross-sectional view of the flexible back support member 16, taken along line B-B of FIG. 13, according to embodiments of the present invention. FIG. 16 illustrates a cross-sectional view of the flexible back support member 16, taken along line C-C of FIG. 13, according to embodiments of the present invention.

Figure 17:
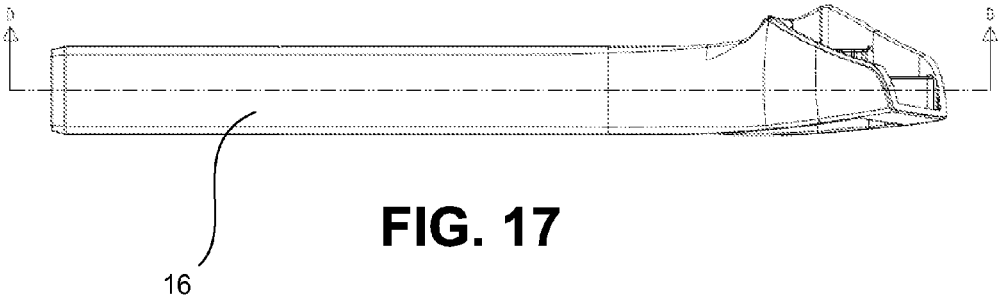
FIG. 17 illustrates a partial cut-away top view of a flexible back support member, according to embodiments of the present invention.
Figure 18:
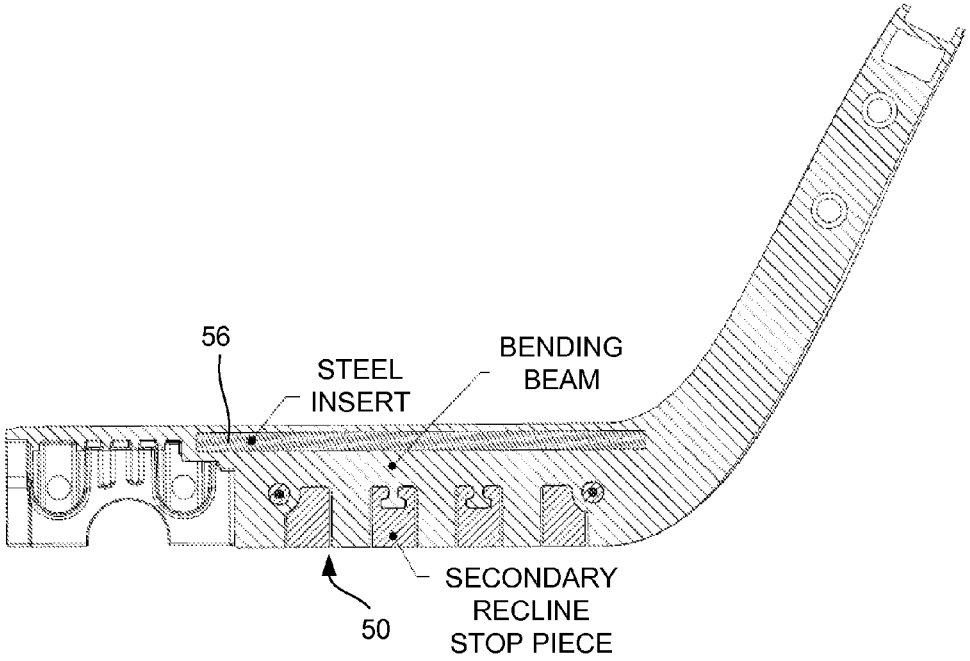
FIG. 18 illustrates a cross-sectional view of the flexible back support member of FIG. 17, taken along line D-D of FIG. 17, according to embodiments of the present invention.
Figure 19:
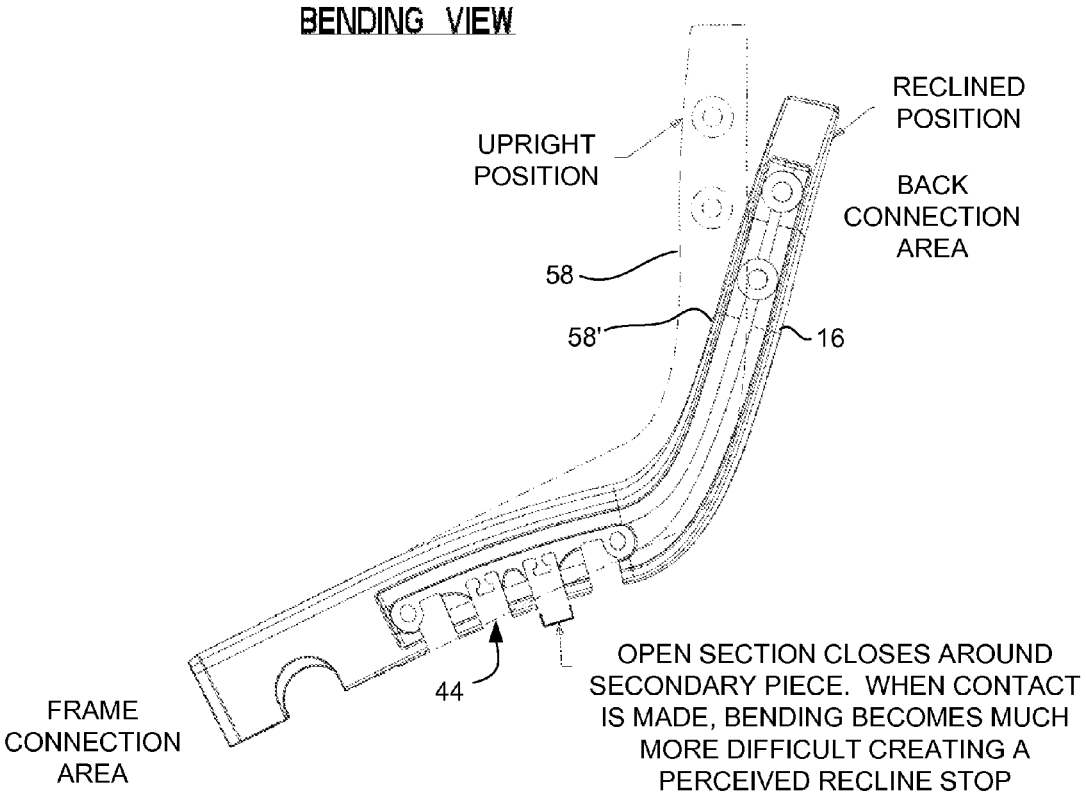
FIG. 19 illustrates a side elevation view of a flexible back support member shown in an upright position in dashed lines, superimposed upon the flexible back support member shown in a reclined position in solid lines, according to embodiments of the present invention.

FIG. 17 illustrates a partial cut-away top view of a flexible back support member 16, according to embodiments of the present invention. FIG. 18 illustrates a cross-sectional view of the flexible back support member 16 of FIG. 17, taken along line D-D of FIG. 17, according to embodiments of the present invention. FIG. 19 illustrates a side elevation view of a flexible back support member 16 shown in an upright position 58 in dashed lines, superimposed upon the flexible back support member 16 shown in a reclined position 58' in solid lines, according to embodiments of the present invention.

The gaps 44 are configured to narrow as the back 12 reclines from an upright position 58 to a reclined position 58', as the flexible back support member 16 undergoes bending, according to embodiments of the present invention. As such, the notches 50 are also configured so as to narrow as the back 12 reclines from an upright position 58 to a reclined position 58'. In other words, at least a portion (e.g. the whole portion and/or a bottom end) of the side surface 54 of each bottom beam section 28 gets closer to at least a portion (e.g. the whole portion and/or a bottom end) of the opposing adjacent side surface 52 of the adjacent bottom insert 34 during reclining, until a point at which the two surfaces make contact, for example contact at or toward their bottom ends, to create a recline "stop," or a position of step increased reclining resistance. In the upright position 58, the notches 50 are open, whereas in a reclined position, the notches 50 are closed, which means that at least a portion of the notch 50 is closed.

As illustrated in FIGS. 13-16, the top beam section 26 at the location of each notch 50 represents the lowest area moment of inertia along the flexible back support member 16 and along the flex zone 48, according to embodiments of the present invention. This causes the flexible back support member 16 to bend more along the flex zone 48 and at the notches 50. The area moment of inertia of the beam section 30 at the location of each bottom beam section 28 is illustrated in FIG. 15, and is larger than the area moment of inertia of the beam section 30 at the location of the notches 50, according to embodiments of the present invention. As such, a minimum area moment of inertia longitudinally along the flex zone 48 in the upright position 58 (e.g. at location of notch 50) is smaller than a minimum area moment of inertia longitudinally along the flex zone 48 in the reclined position 58' (e.g. at location of bottom beam section 28 or bottom insert 34 or the interface between the two). When the notches 50 close or partially close, the effective area moment of inertia for the beam at the location of the closed notches 50 increases to more closely resemble that of FIG. 15. This creates a stop for the reclining motion, as the user experiences a reclining resistance which increases according to a step function when the notches 50 close. If the notches 50 are too wide for a flexible back support member 16 of a given modulus of elasticity and cross-sectional shape, the flexible back support member 16 will recline too far and/or deform in an undesirable way. If the notches 50 are too narrow, the flexible back support member 16 will not recline far enough. The notches 50 may have a substantially uniform width with respect to each other in the upright position 58, according to embodiments of the present invention. Also, the cross-sectional shape of the bottom beam sections 28 may be substantially the same as the cross-sectional shape of the bottom inserts 34 to more evenly distribute the bending stress when the notches 50 close and to permit the flexible back support member 16 to behave more like a uniform beam in bending motion when the notches 50 close, according to embodiments of the present invention.

Using the combination of an insert section 32 along with the beam section 30 to create the notches 50, rather than forming or molding the notches 50 directly into the flexible back support member 16, makes the flex zone 48 easier to manufacture because it is easier to create gaps 44 and the widths of the bottom inserts 34 to a particular tolerance than to create each notch 50 directly to a particular tolerance. In addition, using an insert section 32 permits different insert sections 32 to be used with the same beam section 30, in order to create a custom notch 50 width for a particular flexible back support member 16, and/or to permit an end user or customer to switch insert sections 32 of different materials or of different notch 50 widths to create a different level of reclining resistance and/or flexing properties.

As illustrated in FIGS. 17 and 18, a metal wire 56 may extend at least partially along the flex zone 48; for example, the metal wire may be an insert molded steel spring wire to add strength, resilience, and to move the neutral axis to the center of the steel wire, thus decreasing stresses on the plastic or polymer surrounding the wire 56, according to embodiments of the present invention.

The beam section 30 and insert section 32 may each be molded as a single unit, and/or may each be molded of the same material, for example a molded polymer material, according to embodiments of the present invention. The flexible back support member 16 may include a substantially homogeneous and isotropic modulus of elasticity, according to embodiments of the present invention.

Figure 20A:
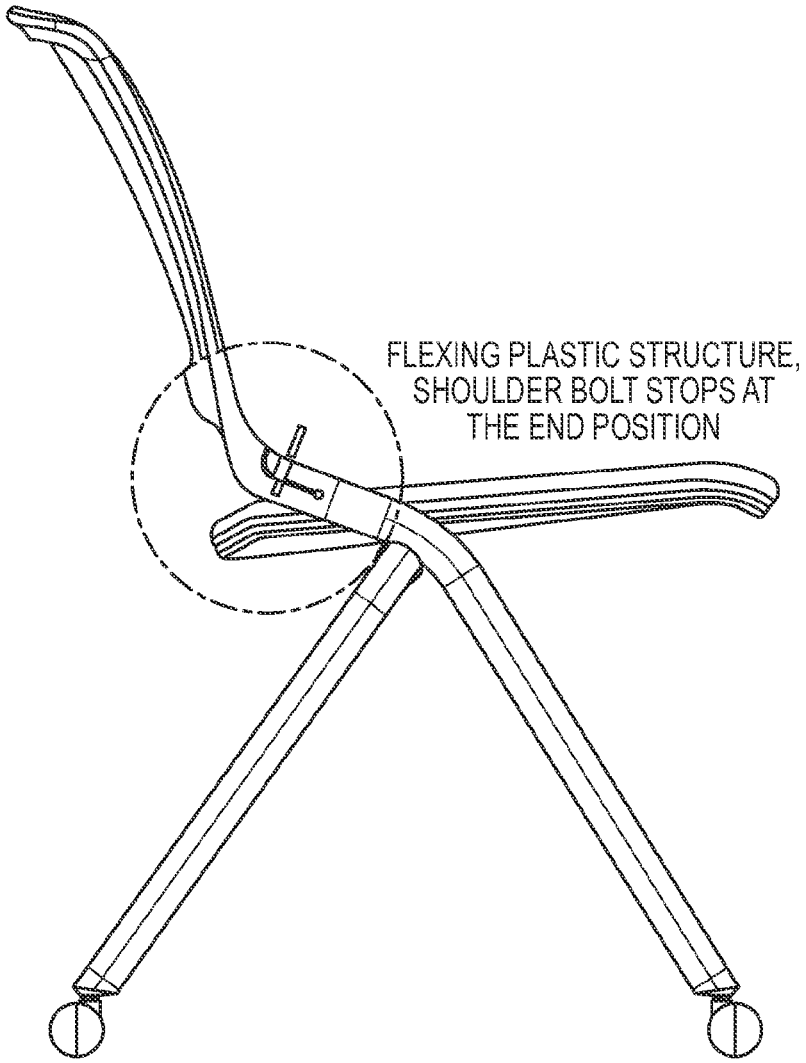
FIGS. 20A through 20G illustrate alternative flexible back support members, according to embodiments of the present invention.
Figure 20B:
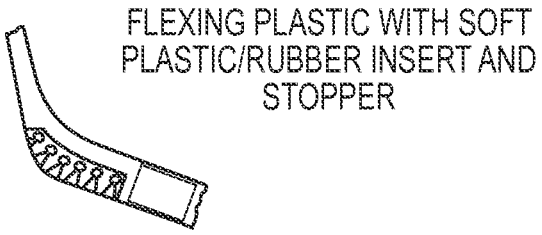
Figure 20C:
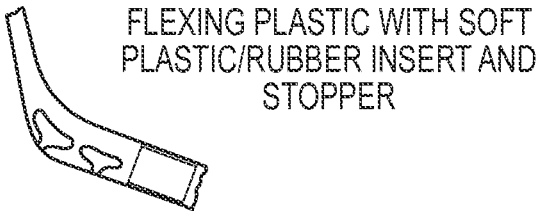
Figure 20D:
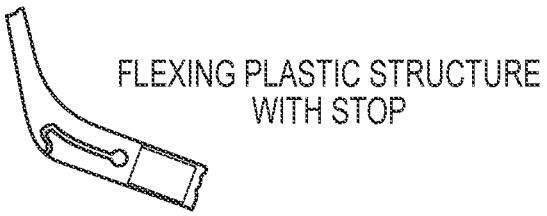
Figure 20E:
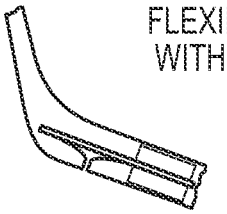
Figure 20F:
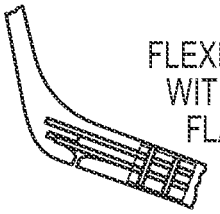
Figure 20G:
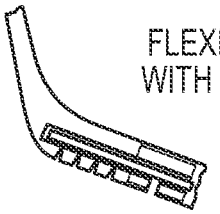

FIGS. 20A through 20G illustrates alternative flexible back support member, according to embodiments of the present invention. FIG. 20A illustrates a flex zone with a flexing plastic or polymer structure, in which a shoulder bolt stops at the end position, according to embodiments of the present invention. FIG. 20B illustrates a flex zone with a flexing plastic with soft plastic and/or rubber inserts and/or stoppers, according to embodiments of the present invention. FIG. 20C illustrates a flex zone with flexing plastic with soft plastic and/or rubber inserts and/or stoppers, according to embodiments of the present invention. FIG. 20D illustrates a flex zone with a flexing plastic structure with a stop, according to embodiments of the present invention. FIG. 20E illustrates a flex zone with a flexing plastic structure with a flat-spring and a stop at the end, according to embodiments of the present invention. FIG. 20F illustrates a flex zone with a flexing plastic structure with two parallel working flat-springs with a stop. FIG. 20G illustrates a flex zone with a flexing plastic structure with a steel or carbon-fiber rod, according to embodiments of the present invention.

Embodiments of the present invention include a flexible back support member that is an injection molded plastic beam in bending, rigidly connected to the base or frame (ground link) and the chair back 12 to allow the back 12 to move relative to the frame (e.g. base including legs 18, 20). The flex zone 48 location creates a relative pivot point near the user's hip joint, so the chair back 12 tracks with the user's back during recline. The flexible back support member's cross section and the material's resistance to bending (Modulus of elasticity) give the system energy to resist recline.

An effective recline stop was created by increasing the beam stiffness significantly through sudden increase in beam cross-section and Moment of Inertia. This was achieved using a secondary part, the insert section 32, according to embodiments of the present invention. Essentially, the two cross-sections are created through notching the larger cross-section to create a smaller one on top. The bending beam of the flexible support member 16 uses an insert molded steel spring wire 56 to add strength, resilience, and move the neutral axis to the center of the steel wire 56, thus decreasing stresses on the plastic, according to embodiments of the present invention. This also allows the feel to be fine tuned by varying the steel wire 56 size and plastic shape around it, as well as more aesthetic freedom because the bending resistance caused by the plastic shape is now contributing less to the system with the wire than it would without a wire (because the plastic shape would be the only contributor to the recline force without the wire, thus locking in aesthetics based on bending requirements).

The shape of the bending beam (e.g. see FIGS. 14-16) locates the neutral axis of bending to a position that optimizes force and minimized stresses, according to embodiments of the present invention. Dueling requirements for minimizing stresses for strength and fatigue life, and prescribing the recline force, resulted in the shape of FIGS. 14-16, according to embodiments of the present invention. Selecting the length of the bending beam (e.g. the flexible back support member 16) may also help balance these requirements. Adding an insert molded steel spring 56 allows for more shape flexibility than would otherwise be possible, according to embodiments of the present invention. A "flatter" top surface of the spring decreases stresses on the bending beam. If the top of the steel spring 56 is more crowned or round, the stresses would concentrate at the peak of the shape, and be more significant than on a flatter section that shares the load, according to embodiments of the present invention. The shape below the flat top surface optimizes moment of inertia requirements for recline and considerations for optimized molding conditions, according to embodiments of the present invention.

According to some embodiments of the present invention, a cross-sectional shape of the flexible back support member 16 between the one or more notches 50 is substantially I-shaped as illustrated in FIG. 15, while the cross-sectional shape of the flexible back support member 16 at the one or more notches 50 is substantially T-shaped as illustrated in FIG. 14. The T-shape of FIG. 14 is the top half of the I-shape of FIG. 15, according to embodiments of the present invention.

The "height" of the larger beam section 30 minimizes stresses during the maximum loading condition in testing and provides a more rigid perceived recline stop when the notched section closes and the larger beam section takes the load. This larger section (e.g. FIG. 15) is technically also a bending beam, though the force to cause bending is significantly greater than the smaller section recline beam (e.g. FIG. 14).

Other shapes and lengths could be used depending on requirements for stiffness, strength, manufacturing process, testing, and the like.

This method of back "pivot" decreases the number of parts that have to be assembled, according to embodiments of the present invention. It allows for a more independent motion from one side to the other, and allows for more visual design freedom and use of lower cost materials and processes (e.g. plastic instead of steel or aluminum castings and mechanical/steel springs). It also allows for a compact and integrated design to minimize chair nesting and stacking distances. Embodiments of the present invention also provide a more unique solution that does not have to be adjusted for various sized users.

According to some embodiments of the present invention, the bending beam (or flexible back support member 16) may be any resilient material, have many different shapes, may be inserted with different size steel springs (or no steel spring), depending on requirements of the system. This bending beam system could also be integrated in many different locations on the chair to cause the back to recline, possibly with a different relative pivot point to the seat.

According to embodiments of the present invention, section changing recline stop could be achieved in various ways. Using separate parts 30, 32 to create a recline stop permits the flex zone 48 components to be molded with large gaps 44 which may be molded using standard injection mold tooling. The flex zone 48 is molded with large gaps 44, which are then filled with a smaller plastic piece 34 to create the smaller notch side 50, according to the degree of recline desired to be permitted in the back 12, according to embodiments of the present invention.

Notches 50 may also be created by cutting slits in the plastic, insert molding, removing a part to form the notches, assembling a secondary piece to create small notches that could not otherwise be molded, and/or over-molding a soft material that compresses in the notches to have a more constant or linear increase in recline force rather than a "hard stop". According to other embodiments of the present invention, a stiffer beam is engaged under the primary bending beam to change the spring rate or increase the moment of inertia of the system. Notch number and size can vary (e.g. one notch or a plurality of notches that close) depending on how tall the "stop" section is and how much back recline is desired, according to embodiments of the present invention.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A chair system comprising:

a base comprising a seat for a user and one or more support legs;

a back reclinable from an upright position to a reclined position; and a flexible back support member including:

a beam section having a top beam section that is integrally formed with a first bottom beam section and a second bottom beam section, an external surface of the first bottom beam section being separated from an external surface of the second bottom beam section by a longitudinal gap; and an insert section coupled to the beam section, the insert section including a bottom insert with a longitudinal length that is less than a longitudinal length of the longitudinal gap, the bottom insert being positioned within the longitudinal gap to create a first notch between the external surface of the first bottom beam section and the bottom insert and a second notch between the external surface of the second bottom beam section and the bottom insert when the back is in the upright position, wherein the external surface of the first bottom beam section contacts the bottom insert and the external surface of the second bottom beam section contacts the bottom insert when the back is in the reclined position.

2. The chair system of claim 1, wherein a minimum area moment of inertia longitudinally along the beam section in the upright position is smaller than a minimum area moment of inertia longitudinally along the beam section in the reclined position.

3. The chair system of claim 1, wherein the first notch and the second notch have a substantially uniform width when the back is in the upright position.

4. The chair system of claim 1, wherein the beam section further comprises a metal wire extending at least partially along the beam section.

5. The chair system of claim 4, wherein the metal wire is an insert molded steel spring wire.

6. The chair system of claim 1, wherein the insert section is removeably coupled to the beam section, the insert section further comprises a crosspiece coupled to the bottom insert, and the insert section is removably coupled to the beam section via the crosspiece.

7. The chair system of claim 1, wherein the insert section is removeably coupled to the beam section, the beam section further comprises a first lateral interlock element in the longitudinal gap, and the insert section comprises a second lateral interlock element that interlocks with the first lateral interlock element when the insert section is removably coupled to the beam section.

8. The chair system of claim 1, wherein the flexible back support member is a first flexible back support member, the beam section is a first beam section, the longitudinal gap is a first longitudinal gap, and the insert section is a first insert section, the chair system further comprising:

a second flexible back support member rigidly coupled to the back and to the base, the second flexible back support member comprising:

a second beam section having a second top beam section that is integrally formed with a third bottom beam section and a fourth bottom beam section, an external surface of the third bottom beam section being separated from an external surface of the fourth bottom beam section by a second longitudinal gap; and an second insert section coupled to the second beam section, the second insert section including a second bottom insert with a second longitudinal length that is less than a longitudinal length of the second longitudinal gap, the second bottom insert being positioned within the second longitudinal gap to create a third notch between the external surface of the third bottom beam section and the second bottom insert and a fourth notch between the external surface of the fourth bottom beam section and the second bottom insert when the back is in the upright position, wherein the external surface of the third bottom beam section contacts the second bottom insert and the external surface of the fourth bottom beam section contacts the second bottom insert when the back is in the reclined position.

9. The chair system of claim 1, wherein the beam section and the insert section are each molded as a single piece.

10. The chair system of claim 1, wherein the flexible back support member comprises a substantially homogeneous and isotropic modulus of elasticity.

11. The chair system of claim 1, wherein the back is reclinable from the upright position to the reclined position through a partially-reclined position, the bottom insert is positioned within the longitudinal gap to create the first notch between the external surface of the first bottom beam section and the bottom insert when the back is in the partially-reclined position, and the external surface of the second bottom beam section contacts the bottom insert when the back is in the partially-reclined position.

12. A method for making a chair, the method comprising:

forming an insert section that includes two or more bottom inserts separated from each other longitudinally by one or more gaps;

forming a flexible back support member that is adapted to couple with the insert section and includes a flex zone defined by a top beam section and one or more bottom beam sections integrally formed with the top beam section, each of the one or more bottom beam sections being adapted to fit within one of the one or more gaps to create notches between external surfaces of adjacent bottom inserts of the two or more bottom inserts and that bottom beam section when the chair back is in an upright position and to contact the external surfaces of the adjacent bottom inserts of the two or more bottom inserts when the chair back is in a reclined position; and rigidly coupling the flexible back support member with a chair base and a chair back, the chair base including a seat for a user and one or more support legs.

13. The method of claim 12, further comprising:

positioning each of one or more bottom beam sections within one of the one or more gaps; and coupling the insert section to the beam section.

14. The method of claim 12, wherein forming the insert section includes customizing a width of the one or more notches by selecting a width for each of the two or more bottom inserts.

15. The method of claim 12, wherein forming the insert section includes forming a crosspiece adapted to couple the insert section to the flexible back support member.

16. The method of claim 12, wherein forming the flexible back support member includes insert molding a metal wire at least partially along the flex zone.

17. The method of claim 16, wherein the metal wire has a top surface flatter than a crowned or round top surface.

18. The method of claim 12, wherein forming the flexible back support member comprises molding the flexible back support member as a single unitary piece.

19. A chair kit comprising:

a base coupled to a seat for a user and one or more support legs;

a back;

a flexible back support member rigidly coupled to the back and to the base, the flexible back support member including a flex zone defined by a top beam section extending continuously along the flex zone, a first bottom beam section, and a second bottom beam section, the bottom beam sections being separated from each other longitudinally by a gap;

a first insert section adapted to removeably couple to the beam section and including a first bottom insert that is adapted to be positioned within the gap and to form first and second notches between the first and second bottom beam sections, respectively, the first notch having a first longitudinal length when the back is in an upright position that decreases as the back moves from the upright position to a reclined position, and the second notch having a second longitudinal length when the back is in the upright position that decreases as the back moves from the upright position to the reclined position; and a second insert section adapted to removeably couple to the beam section and including a second bottom insert that is adapted to be positioned within the gap and to form third and fourth notches between the first and second bottom beam sections, respectively, the third notch having a third longitudinal length when the back is in an upright position that is less than the first longitudinal length and that decreases as the back moves from the upright position to a reclined position, and the fourth notch having a fourth longitudinal length when the back is in the upright position that is less than the second longitudinal length and that decreases as the back moves from the upright position to the reclined position.

20. The chair kit of claim 19, wherein the first bottom insert is adapted to contact the first and second bottom beam sections when the back is in the reclined position.

* * * * *